US009517625B2

(12) United States Patent
Goto et al.

(10) Patent No.: US 9,517,625 B2
(45) Date of Patent: Dec. 13, 2016

(54) LIQUID DISCHARGE HEAD AND METHOD OF MANUFACTURING THE SAME

(71) Applicant: CANON KABUSHIKI KAISHA, Tokyo (JP)

(72) Inventors: Akio Goto, Tokyo (JP); Hiroshi Higuchi, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/076,426

(22) Filed: Nov. 11, 2013

(65) Prior Publication Data

US 2014/0132672 A1 May 15, 2014

(30) Foreign Application Priority Data

Nov. 15, 2012 (JP) ..... 2012-251482

(51) Int. Cl.
*B41J 2/14* (2006.01)
*B41J 2/16* (2006.01)

(52) U.S. Cl.
CPC ..... *B41J 2/1621* (2013.01); *B41J 2/1603* (2013.01); *B41J 2/1628* (2013.01); *B41J 2/1629* (2013.01); *B41J 2/1631* (2013.01); *B41J 2/1639* (2013.01); *B41J 2/1642* (2013.01); *B41J 2/1645* (2013.01); *B41J 2/1646* (2013.01); *Y10T 29/49401* (2015.01)

(58) Field of Classification Search
CPC ..... B41J 2/1631; B41J 2/1433; B41J 2/162; B41J 2/1626; B41J 2/1621; B41J 2/1642; B29C 33/0061
USPC ..... 347/44, 47
See application file for complete search history.

(56) References Cited

U.S. PATENT DOCUMENTS

| | | | | |
|---|---|---|---|---|
| 6,036,105 | A * | 3/2000 | Sanada | B41J 2/14201 239/102.1 |
| 6,176,571 | B1 * | 1/2001 | Kishima et al. | 347/70 |
| 6,341,836 | B1 * | 1/2002 | Koike et al. | 347/20 |
| 6,547,373 | B2 * | 4/2003 | Kitahara | 347/68 |
| 6,679,595 | B2 * | 1/2004 | Yamada | B41J 2/14209 347/20 |
| 7,325,310 | B2 * | 2/2008 | Kim | 29/890.1 |
| 7,475,966 | B2 * | 1/2009 | Fujii et al. | 347/65 |
| 7,594,714 | B2 * | 9/2009 | Katayama | B41J 2/14201 347/68 |

(Continued)

FOREIGN PATENT DOCUMENTS

| | | |
|---|---|---|
| CN | 102152635 A | 8/2011 |
| JP | 2002-001966 A | 1/2002 |
| JP | 2010512262 A | 4/2010 |

*Primary Examiner* — Matthew Luu
*Assistant Examiner* — Patrick King
(74) *Attorney, Agent, or Firm* — Canon U.S.A., Inc. IP Division

(57) ABSTRACT

A liquid discharge head includes a substrate and a flow-path-forming member that forms a plurality of flow paths and discharge ports that are in communication with the flow paths on the substrate. Liquid is to be discharged from the discharge ports. A space is formed between the plurality of flow paths and is filled with a filling material. In the case where a direction in which the liquid is to be discharged from the discharge ports is an upward direction, a top surface of the filling material is positioned at the same height as a face surface of the flow-path-forming member or is positioned higher than the face surface of the flow-path-forming member in the upward direction.

6 Claims, 3 Drawing Sheets

(56) References Cited

U.S. PATENT DOCUMENTS

| | | | | |
|---|---|---|---|---|
| 8,622,516 | B2 * | 1/2014 | Hamade | 347/40 |
| 2002/0003556 | A1 * | 1/2002 | Mori | 347/50 |
| 2002/0041310 | A1 * | 4/2002 | Kaneko et al. | 347/65 |
| 2004/0040152 | A1 * | 3/2004 | Kigami et al. | 29/890.1 |
| 2007/0030317 | A1 * | 2/2007 | Igarashi | B41J 2/1603 347/68 |
| 2009/0233386 | A1 * | 9/2009 | Guan et al. | 438/21 |
| 2011/0120627 | A1 | 5/2011 | Mihara et al. | |
| 2012/0086750 | A1 * | 4/2012 | Hamade | B41J 2/1603 347/20 |
| 2012/0236076 | A1 * | 9/2012 | Dixon et al. | 347/40 |

* cited by examiner

LIQUID DISCHARGE HEAD AND METHOD OF MANUFACTURING THE SAME

BACKGROUND OF THE INVENTION

Field of the Invention

The present invention relates to a liquid discharge head and a method of manufacturing the liquid discharge head.

Description of the Related Art

A recording apparatus that records an image by discharging liquid such as ink or the like and that is represented by an ink jet recording apparatus includes a liquid discharge head. A discharge port is formed in such a liquid discharge head, and liquid is discharged from the discharge port using energy that is generated from an energy generating element.

Such a liquid discharge head includes a substrate and a flow-path-forming member. The flow-path-forming member is formed on the substrate and is a member that forms a flow path in which liquid flows and a discharge port that is in communication with the flow path. The flow-path-forming member is made of a resin, a metal, or an inorganic material such as silicon nitride.

Usually, a plurality of flow paths (liquid chambers) are formed on a substrate, and discharge ports each of which corresponds to one of the flow paths is formed. The plurality of flow paths, that is, the liquid chambers adjacent to each other are separated from each other by a flow-path-forming member that forms each of the liquid chambers.

A space may sometimes be formed between the plurality of the flow paths, that is, between a portion of the flow-path-forming member that forms one of the flow paths and a portion of the flow-path-forming member that forms a different one of the flow paths that is adjacent to the one of the flow paths. A liquid discharge head that includes a flow-path-forming member made of an inorganic material is described in PCT Japanese Translation Patent Publication No. 2010-512262 (hereinafter referred to as "Patent Document 1"). In a process of manufacturing a liquid discharge head described in Patent Document 1, mold members each of which is configured to form a flow path (a liquid chamber) are formed on a substrate, and an inorganic film is applied by a chemical vapor deposition method (a CVD method) in such a manner as to cover the mold members. Then, discharge ports are formed in the inorganic film, and at last, the mold members are removed, so that the flow paths are formed. In a liquid discharge head that is manufactured by such a method, an inorganic film is formed along mold members each of which has the shape of a liquid chamber, and thus, a space is formed between the mold members. In other words, a space is formed in a flow-path-forming member formed between the flow paths. In the case where a space is formed in the flow-path-forming member in this manner, the strength of the liquid discharge head may sometimes be low. Accordingly, Patent Document 1 describes that such a space is filled with a filling material.

SUMMARY OF THE INVENTION

The present invention provides a liquid discharge head that includes a substrate and a flow-path-forming member that forms a plurality of flow paths and discharge ports that are in communication with the flow paths on the substrate. Liquid is to be discharged from the discharge ports. A space is formed between the plurality of flow paths and is filled with a filling material. In the case where a direction in which the liquid is to be discharged from the discharge ports is an upward direction, a top surface of the filling material is positioned at the same height as a face surface of the flow-path-forming member or is positioned higher than the face surface of the flow-path-forming member in the upward direction.

Further features of the present invention will become apparent from the following description of exemplary embodiments with reference to the attached drawings.

DESCRIPTION OF THE EMBODIMENTS

In the liquid discharge head described in Patent Document 1, in recent years, there has been a need to improve the discharge efficiencies of liquid discharge heads and to reduce the size of liquid droplets that are discharged from such liquid discharge heads. In order to achieve this, the thickness of a flow-path-forming member, particularly the thicknesses of regions of the flow-path-forming member that are around the periphery of discharge ports and that are so-called orifice plates may be reduced.

In the case where the thicknesses of orifice plates are reduced, the strengths of the orifice plates become low. As a result, for example, in the case where a face surface that is the top surface of each of the orifice plates makes contact with a recording medium that was deformed during transportation or the like, the orifice plates are likely to get damaged. In the case where the face surface gets damaged, there is a possibility that the discharge ports become deformed. In addition, in the liquid discharge head described in Patent Document 1, the flow-path-forming member including the orifice plates is formed by the CVD method, and thus, in the case where the thicknesses of the orifice plates are reduced, the thickness of the entire flow-path-forming member is reduced. As a result, the strength of the entire flow-path-forming member is reduced, and the flow-path-forming member is likely to get damaged by a contact with a recording medium or the like.

Accordingly, the present invention provides a liquid discharge head in which a flow-path-forming member is not likely to get damaged even if the flow-path-forming member makes contact with a recording medium or the like.

Figure 1A:
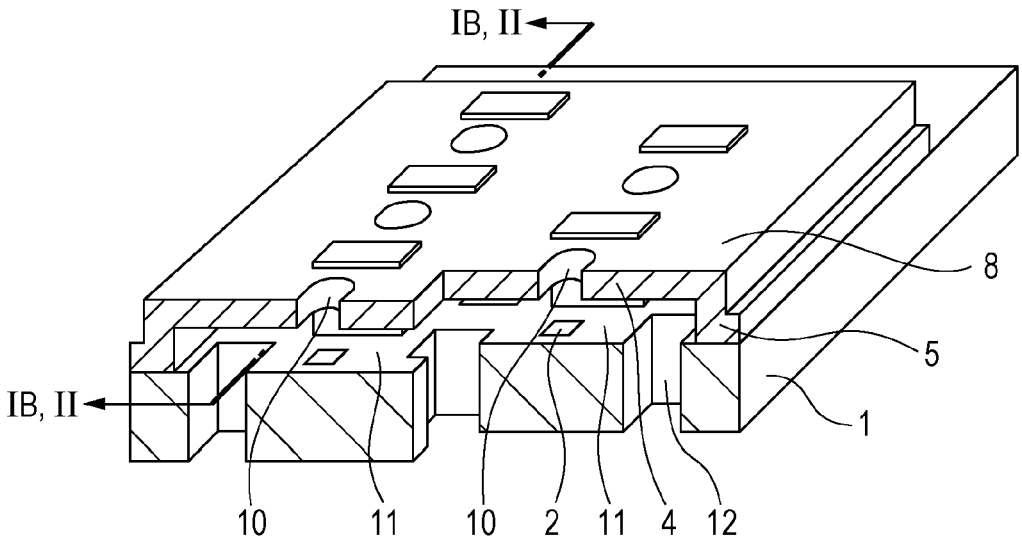
FIGS. 1A and 1B are diagrams illustrating an example of a liquid discharge head according to the present invention.

FIG. 1A is a diagram illustrating an example of a liquid discharge head according to the present invention. The liquid discharge head includes a substrate 1, energy generating elements 2, and a flow-path-forming member 5. The substrate 1 is made of silicon or the like. Each of the energy generating elements 2 is formed of a thermal conversion element (a heater) that is made of TaSiN or the like or a piezoelectric element. Although the energy generating elements 2 are disposed on the substrate 1, the energy generating elements 2 need not be in contact with the substrate 1 and may be arranged in such a manner as to float above the substrate 1. The flow-path-forming member 5 is made of a resin, a metal or an inorganic material. An example of a resin is a photosensitive resin such as an epoxy resin. An example of a metal is a SUS plate, and examples of an inorganic material are SiN, SiC, SiCN and the like. FIG. 1A illustrates the case where the flow-path-forming member 5 is made of an inorganic material. The flow-path-forming member 5 forms a plurality of flow paths 11 and discharge ports 10 each of which is in communication with a corresponding one of the flow paths 11. Each of the plurality of flow paths 11 forms a liquid chamber that corresponds to one of the discharge ports 10. Portions of the flow-path-forming member 5 around the periphery of the discharge ports 10 are referred to as orifice plates 4. The top surface of each of the orifice plates 4 of the flow-path-forming member 5 is a face surface 8. In FIG. 1A, the face surface 8 is the top surface of the flow-path-forming member 5. A supply port 12 is formed in the substrate 1 by dry etching, wet etching using TMAH or the like, laser processing, or the like. Liquid that was supplied from the supply port 12 is energized by the energy generating elements 2 and is discharged from the discharge ports 10.

Figure 1B:
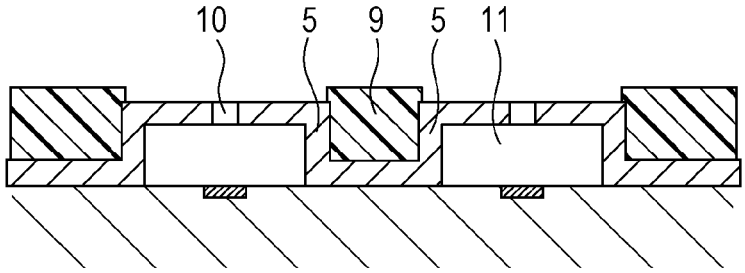

FIG. 1B is a sectional view taken along line IB-IB of FIG. 1A. A space is formed in the flow-path-forming member 5 formed between the flow paths 11, and the space is filled with a filling material 9. A stress applied to the flow-path-forming member 5 is reduced by filling the space, which has been formed between the plurality of flow paths 11, with the filling material 9, and the strength of the flow-path-forming member 5 can be enhanced.

Here, in the liquid discharge head according to the present invention, in the case where a direction in which liquid is discharged from the discharge ports 10 is an upward direction, that is, in the case where a direction that is perpendicular to a surface of the substrate 1 and that is the flow direction of the liquid, which has been discharged, is an upward direction, the top surface of a filling member that is made of the filling material 9 is positioned at the same height as the face surface 8 of the flow-path-forming member 5 or is positioned higher than the face surface 8 of the flow-path-forming member 5 in the upward direction. As a result, even if a recording medium that has been deformed due to, for example, a paper jam or the like comes into contact with the liquid discharge head from the upward direction, the filling member, which is made of the filling material 9, makes contact with the recording medium first, so that occurrence of breakage of the flow-path-forming member 5, particularly the face surface 8 can be suppressed. A plurality of the filling members, each of which is made of the filling material 9, may be arranged in the liquid discharge head. The filling members, each of which is made of the filling material 9, may be arranged in such a manner that one of the discharge ports 10 is interposed between the filling members, each of which is made of the filling material 9, when the face surface 8 is viewed from above.

A method of manufacturing the liquid discharge head according to the present invention will now be described with reference to FIGS. 2A to 2I. FIGS. 2A to 2I are sectional views taken along line II-II of FIG. 1A.

Figure 2A:
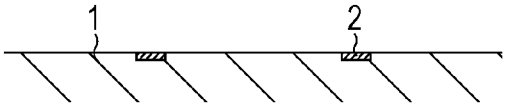
FIGS. 2A to 2I are diagrams illustrating an example of a method of manufacturing the liquid discharge head according to the present invention.

First, as illustrated in FIG. 2A, the substrate 1 that includes the energy generating elements 2 is prepared. The substrate 1 may be a silicon single-crystal substrate. In the case where the substrate 1 is a silicon single-crystal substrate, a driving circuit that drives the energy generating elements 2 and wiring that connects the driving circuit and the energy generating elements 2 can be easily formed. Each of the energy generating elements 2 is formed of, for example, a thermal conversion element (a heater) that is made of TaSiN or the like or a piezoelectric element.

Figure 2B:
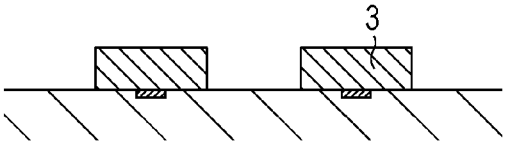

Next, as illustrated in FIG. 2B, mold members 3 each of which is configured to form the pattern of a corresponding one of the flow paths 11 (the liquid chambers) are formed. The material out of which the mold members 3 are made is selected in accordance with the balance between the heat resistance of each of the mold members 3 and the material of the peripheral portions. For example, in the case where the flow-path-forming member 5 is made of an inorganic material, the mold members 3 may be made of a resin or a metal. In the case where the mold members 3 are made of a resin, a polyimide may be used with consideration of the heat resistance of each of the mold members 3 in a film deposition process for the flow-path-forming member 5 that is to be subsequently performed. In the case where the mold members 3 are made of a metal, aluminum or an aluminum alloy may be used with consideration of the removability of each of the mold members 3. In the case where reflectivity is used for sensing an end point of grinding, and a material that transmits light is used as a grinding-stop layer 7 at a later time, the mold members 3 may be made of a metal having a high reflectivity, and the end point may be sensed on the basis of a difference between the reflectivities of the mold members 3 and the reflectivity of the filling material 9. Examples of a metal having a high reflectivity are gold, silver, copper, aluminum, rhodium, nickel, chrome, and the like.

In the case where the mold members 3 are made of a metal, first, the metal is formed into a film on the substrate 1 by a physical vapor deposition method (a PVD method) such as sputtering. Next, masks are formed of, for example, a photosensitive resin, and patterning of the metal film is performed by reactive ion etching (RIE) using an etching gas that corresponds to the metal, which has been selected. In the case where the metal is aluminum, the etching gas may be chlorine gas. In the case where the mold members 3 are made of a resin, a material including the resin is applied onto the substrate 1 by spin coating or the like and is formed into a film. Next, in the case where the resin is a photosensitive resin, patterning can be performed by photolithography. In the case where the material is a non-photosensitive material, masks are formed of a photosensitive resin or the like onto the non-photosensitive material, and patterning can be performed by etching using oxygen gas.

Figure 2C:
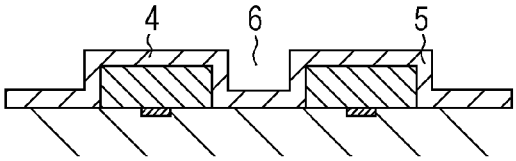

After the mold members 3 are formed, as illustrated in FIG. 2C, an inorganic material is formed in such a manner as to cover the substrate 1 and the mold members 3 by a chemical vapor deposition method (a CVD method). As a result, the flow-path-forming member 5 including the orifice plates 4 is formed of the inorganic material. The inorganic material that forms the flow-path-forming member 5 may be a material that is highly resistant to liquid to be discharged and that has a high mechanical strength. In particular, the material may be a compound of any combination of silicon, oxygen, nitrogen, and carbon. More specifically, examples of the compound are silicon nitride (SiN), silicon dioxide ($SiO_2$), silicon carbide (SiC), silicon carbonitride (SiCN), and the like. Considering the heat resistance of each of the mold members 3, the inorganic material may be formed into a film by a plasma enhanced CVD (PECVD) method. In the case where the CVD method is employed, the level of the inorganic material film in regions in which the mold members 3 are arranged is different from that in a region in which the mold members 3 are not arranged because the inorganic material film has a property of being conformally formed into a film, and as a result, a space 6 is formed between the mold members 3.

The discharge efficiency improves as the thicknesses of the orifice plates 4 are reduced. However, in the case where the thicknesses of the orifice plates 4 are reduced, the thickness of the flow-path-forming member 5, which has a thickness substantially the same as that of each of the orifice plates 4, is also reduced. In view of this, the thickness of each of the orifice plates 4 may be 3.0 μm or more and 12.0 μm or less. Similarly, the thickness of the flow-path-forming member 5 may be 3.0 μm or more and 12.0 μm or less.

Figure 2D:
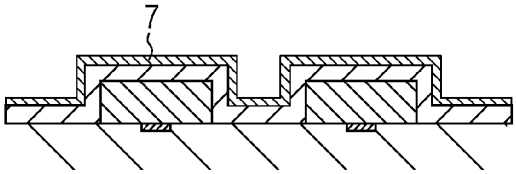

Next, as illustrated in FIG. 2D, the grinding-stop layer 7 is formed on the flow-path-forming member 5. The grinding-stop layer 7 is formed in such a manner as to cover at least regions of the flow-path-forming member 5 in which the discharge ports 10 are to be formed. In other words, the grinding-stop layer 7 is formed on the orifice plates 4 of the flow-path-forming member 5. The grinding-stop layer 7 is made of an inorganic film or a metal. In addition, the grinding-stop layer 7 may be made of a material having a high hardness in order to suppress breakage of the orifice plates 4 due to excessive grinding. In the case where the grinding-stop layer 7 is used for sensing an end point of grinding at a later time, a difference between the reflectivity of the grinding-stop layer 7 and the reflectivity of the filling material 9 will be measured, and thus, the grinding-stop layer 7 may be made of a material having a high reflectivity or a material having a high transmittance. More specifically, the grinding-stop layer 7 may be made of aluminum, an aluminum alloy, or the like. In the case of a material out of which the grinding-stop layer 7 is made is a metal, the metal can be formed into a film by, for example, the PVD method such as sputtering.

The thickness of the grinding-stop layer 7 may be small as long as the grinding-stop layer 7 is not completely ground away during grinding. For example, in the case where the grinding-stop layer 7 is made of aluminum, the thickness of the grinding-stop layer 7 may be 0.05 μm or more and 2.00 μm or less.

Figure 2E:
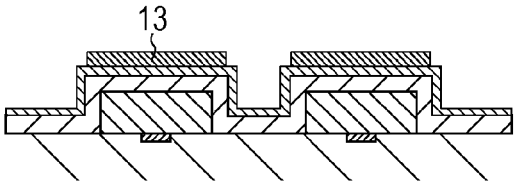
Figure 2F:
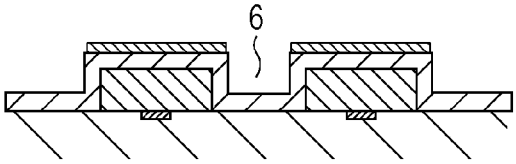

Next, an unnecessary portion of the grinding-stop layer 7, which has been formed in a film, that is, for example, a portion of the grinding-stop layer 7 in the vicinity of a space 6 is removed. Regions of the grinding-stop layer 7 in which the discharge ports 10 of the flow-path-forming member 5 are to be formed are left behind. In the case where the material, which has been formed in a film, is a metal material, as illustrated in FIG. 2E, masks 13 are formed by patterning a photosensitive resin by using photolithography, and the unnecessary portion of the grinding-stop layer 7 is removed by reactive ion etching (RIE) using an etching gas that corresponds to the metal material or the like. In the case the material is aluminum, the unnecessary portion of the grinding-stop layer 7 is removed by RIE using chlorine gas. After that, the masks 13 are peeled off by an organic solvent or the like, so that a state illustrated in FIG. 2F is obtained.

Figure 2G:
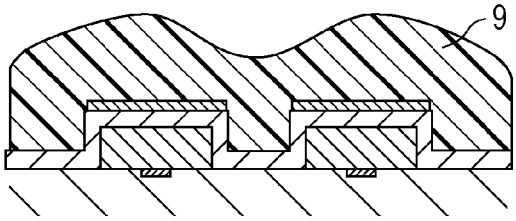

Next, as illustrated in FIG. 2G, the filling material 9 is applied onto the entire surface of the substrate 1 including the space 6 in such a manner that the space 6 is filled with the filling material 9. The filling material 9 may be made of a resin. Since the filling material 9 will be left behind as a part of the flow-path-forming member 5, in the case where a resin is used for making the filling material 9, a negative-type photosensitive resin that is cured by light or a thermosetting resin that is cured by heat may be used. More specifically, examples of the resin are an epoxy resin, a polyimide resin, and the like. In the case where reflectivity is utilized for sensing an end point of grinding at a later time, for example, a resin to which a light absorbing agent containing carbon fine particles such as carbon black, iron oxide fine particles, or the like is added may be used. The application of the filling material 9 is performed by spin coating or the like. In order to sufficiently fill the space 6 with the filling material 9, the thickness of the filling material 9 from the surface of the substrate 1 when the filling material 9 has been applied may be 1.3 times or more the depth of the space 6 and is preferably 1.5 times or more the depth of the space 6. However, in the case where the thickness of the filling material 9 is too large, the length of time for grinding the filling material 9 in a subsequent process increases. Therefore, the thickness of the filling material 9 may be less than or equal to 3.0 times the depth of the space 6 and is preferably less than or equal to 2.0 times the depth of the space 6.

Figure 2H:
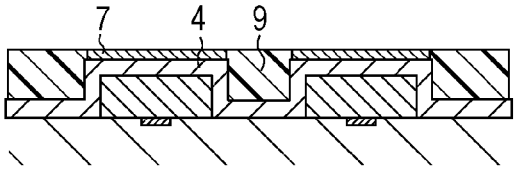

Next, as illustrated in FIG. 2H, the filling material 9 is ground. The grinding of the filling material 9 is performed at least until the grinding-stop layer 7 is exposed. The top surface of the filling member, which is made of the filling material 9, and the top surface of the grinding-stop layer 7 may be made flat by grinding. The grinding of the filling material 9 may be performed by a chemical mechanical polishing method (a CMP method). The top surface of the filling member, which is made of the filling material 9, and the top surface of the grinding-stop layer 7 may be made flat with high accuracy by the CMP method. When grinding is performed, an end point of the grinding may be sensed by detecting a difference between the grinding speed at which the filling material 9 is ground and the grinding speed at which the grinding-stop layer 7 is ground or a difference between the grinding speed at which the filling material 9 is ground and the grinding speed at which the flow-path-forming member 5 is ground. More specifically, the grinding speed at which only the filling material 9 is ground and the grinding speed at which the filling material 9 and the grinding-stop layer 7 are ground because the grinding-stop layer 7 is exposed are different from each other. Exposure of the grinding-stop layer 7 is recognized by detecting the difference in grinding speed. Similarly, exposure of the flow-path-forming member 5 is recognized in the same manner. Alternatively, exposure of the grinding-stop layer 7 may be recognized on the basis of not only the difference in grinding speed but also the difference in reflectivity. For example, an end point of grinding may be also sensed by an optical measuring method that utilizes a difference between the reflectivity of the filling material 9 and the reflectivity of the flow-path-forming member 5 in the case where the flow-path-forming member 5 is not transparent and that utilizes a difference between the reflectivity of the filling material 9 and the reflectivities of the mold members 3 in the case where the flow-path-forming member 5 is transparent. Alternatively, a method of detecting a difference between the reflectivity of the filling material 9 and the reflectivity of the grinding-stop layer 7 instead of the difference between the reflectivity of the filling material 9 and the reflectivity of the flow-path-forming member 5 may be used.

When grinding is performed, a soft material to be ground is excessively ground compared with a hard material to be ground due to the difference in hardness between these materials, and as a result, a dent, that is, a phenomenon called dishing is generated in the soft material. The depth of dishing that occurs in the filling material 9 in the space 6 due to grinding may be small. The depth of dishing may be less than or equal to the thickness of the grinding-stop layer 7.

Figure 2I:
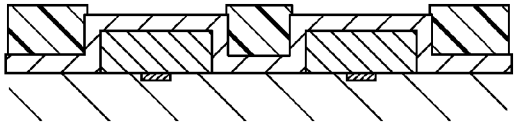

Next, as illustrated in FIG. 2I, the grinding-stop layer 7 is removed. In the case where the grinding-stop layer 7 is made of a metal material, the grinding-stop layer 7 is removed by, for example, wet etching using a liquid that can dissolve the metal material. For example, in the case where aluminum is used as the metal material, an acidic solution that contains phosphoric acid or the like or a basic solution may be used. Alternatively, the grinding-stop layer 7 may be removed by chemical dry etching using a gas containing fluorine and oxygen as main components.

Finally, masks are formed of a photosensitive resin by photolithography as may be necessary, and dry etching is performed on the orifice plates 4 using the masks, so that the discharge ports 10 are formed. Then, the mold members 3 are removed, so that the flow paths 11 are formed, and the supply port 12 is formed in the substrate 1. As a result, the liquid discharge head is manufactured. In the case where a photosensitive resin is applied to a surface in which a space (a recess) is formed, the photosensitive resin usually needs to be applied thickly in order to sufficiently coat the space the level of which is different from that of the surface. When the thickness of the photosensitive resin is large, the accuracy with which the photosensitive resin is patterned by light exposure is likely to deteriorate. On the other hand, when the photosensitive resin is applied thinly in order to improve the patterning accuracy, the space the level of which is different from that of the surface will not be sufficiently coated. As a result, masks that coat the space the level of which is different from that of the surface are completely etched away during dry etching that is performed to form discharge ports, and an orifice plate around the space may sometimes be etched. In the liquid discharge head according to the present invention, since the grinding-stop layer 7 that is to be removed is thick, the top surface of the filling member, which is made of the filling material 9, is positioned higher than the face surface 8, and thus, in the case where the space 6 the level of which is different from that of the grinding-stop layer 7, is not sufficiently coated, the dry etching damages the filling member, which is made of the filling material 9, rather than the orifice plates 4. The degree of accuracy required for the thickness of the filling material 9 is low compared with that required for the orifice plates 4. An etching amount of the filling material 9 can be reduced by increasing the etching rate for the orifice plates 4 when the discharge ports 10 are formed. Therefore, the damage to the filling member, which is made of the filling material 9, will not really be a problem, and the film thickness of the photosensitive resin can be reduced. As a result, the accuracy with which the photosensitive resin is patterned by light exposure is improved, and the accuracy with which the discharge ports 10 are formed is improved.

In the above manufacturing method, in the case where a direction in which liquid is discharged from the discharge ports 10 is an upward direction, the top surface of the filling member, which is made of the filling material 9, can be positioned at the same height as the face surface 8 of the flow-path-forming member 5 or can be positioned higher than the face surface 8 of the flow-path-forming member 5 in the upward direction by removing the grinding-stop layer 7. When the grinding-stop layer 7 is simply removed, the position of the top surface of the filling member, which is made of the filling material 9, becomes higher than the position of the face surface 8 of the flow-path-forming member 5 by an amount equal to the thickness of the grinding-stop layer 7. However, the position of the top surface of the filling member, which is made of the filling material 9, can be made to be at the same height as the positions of the top surfaces of the orifice plates 4 by scraping off the surface of the filling member, which is made of the filling material 9, in such a manner that the surface is at the same height as the face surface 8 in addition to removing the grinding-stop layer 7.

With the configuration according to the present invention, even if a recording medium is brought into contact with a recording head from the upward direction, the filling member, which is made of the filling material 9, makes contact with the recording medium, and the occurrence of breakage of the flow-path-forming member 5, particularly the face surface 8 can be suppressed.

Figure 3:
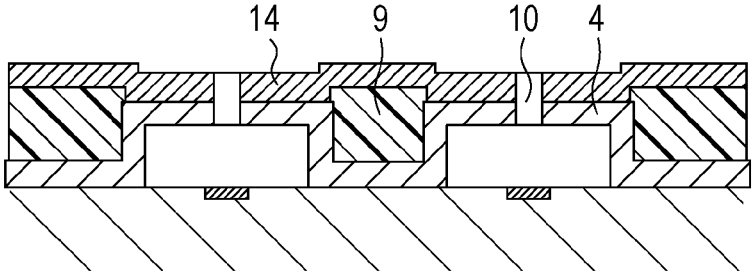
FIG. 3 is a diagram illustrating another example of the liquid discharge head according to the present invention.

FIG. 3 illustrates another example of the liquid discharge head according to the present invention. In the liquid discharge head illustrated in FIG. 3, the top surface of the filling member, which is made of the filling material 9, is sealed with a seal member 14. The seal member 14 may be formed in such a manner as to extend from the top surface of the filling member, which is made of the filling material 9, to the face surface 8 of the flow-path-forming member 5. In the liquid discharge head illustrated in FIG. 1B, the top surface of the filling member, which is made of the filling material 9, and the face surface 8 of the flow-path-forming member 5 are exposed at a surface of the liquid discharge head. However, in the liquid discharge head illustrated in FIG. 3, the top surface of the filling member, which is made of the filling material 9, and the face surface 8 of the flow-path-forming member 5 are not exposed at a surface of the liquid discharge head. The liquid discharge head illustrated in FIG. 3 has a configuration the same as that of the liquid discharge head illustrated in FIG. 1B except for the above. In the liquid discharge head illustrated in FIG. 3, since the top surface of the filling member, which is made of the filling material 9, is sealed with the seal member 14, swelling and elution of the filling material 9 due to moisture in the atmosphere or liquid that is to be discharged can be suppressed, and occurrence of damage to the filling member, which is made of the filling material 9, due to friction with a recording medium can be suppressed.

The liquid discharge head illustrated in FIG. 3 is manufactured by a method that is the same as the method illustrated in FIG. 1 during the period from the preparation of the substrate 1 to the removal of the grinding-stop layer 7. A difference from the method illustrated in FIG. 1 is that the seal member 14 is formed into a film in such a manner as to extend from the top surface of the filling member, which is made of the filling material 9, to the face surface 8 of the flow-path-forming member 5 after the removal of the grinding-stop layer 7. The seal member 14 may be made of the same material as the orifice plates 4 or may be made of a different material from the orifice plates 4. In the case where the same material is used, the adhesion strength between the orifice plates 4 and the seal member 14 can be improved. Note that using the same material means that, in the case where the orifice plates 4 are made of, for example, silicon monoxide (SiO), the seal member 14 is also made of SiO. Even if there is a slight difference in molecular weight, the ratio of molecules contained, or the like between a material out of which the orifice plates 4 are made and a material out of which the seal member 14 is made, these materials are considered to be the same material. In the case where the seal member 14 is made of an inorganic material, the seal member 14 can be made by the CVD method. In the case where the seal member 14 is made of a material different from that of the orifice plates 4, a material that is highly resistant to liquid that is to be discharged and that has a higher mechanical strength than the material of the orifice plates 4 and that does not easily separate from the orifice plates 4 may be used. For example, the material may be a compound of any combination of silicon, oxygen, nitrogen, and carbon. More specifically, examples of the compound are silicon nitride (SiN), silicon dioxide ($SiO_2$), silicon carbide (SiC), silicon carbonitride (SiCN), and the like. Note that although it is necessary to ensure that the seal member 14 has a good sealing performance, the seal member 14 may be thin for a reason similar to that in the case of the orifice plates 4. Considering this, the thickness of the seal member 14 may be 0.1 μm or more and 2.0 μm or less. In the case where the discharge ports 10 are formed in the seal member 14, the discharge ports 10 may be formed in the seal member 14 at the same time as the discharge ports 10 are formed in the orifice plates 4.

Figure 4A:
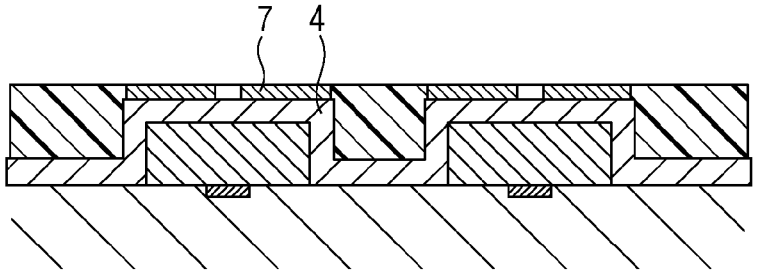
FIGS. 4A to 4C are diagrams illustrating another example of the method of manufacturing the liquid discharge head according to the present invention.
Figure 4B:
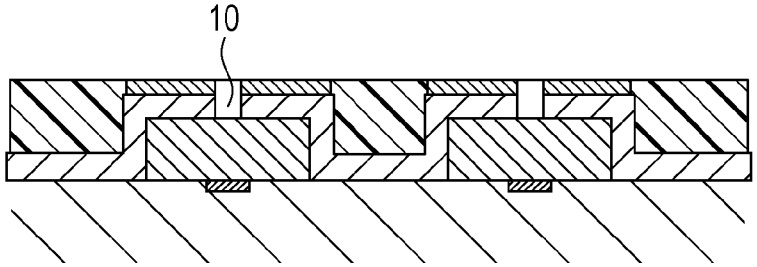
Figure 4C:
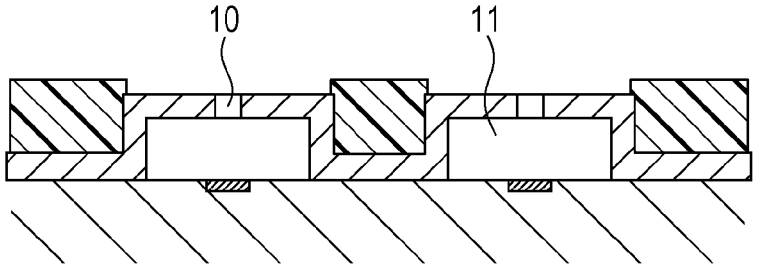

In addition, in the method of manufacturing the liquid discharge head according to the present invention, the grinding-stop layer 7 may be used as a mask when the discharge ports 10 are formed in the flow-path-forming member 5. Since the grinding-stop layer 7 has a high selection ratio with respect to the orifice plates 4 at the time of etching compared with a photosensitive resin, the amount by which the mask recedes is small, and the discharge ports 10 can be formed with high accuracy. The case where the grinding-stop layer 7 is used as a mask will be described with reference to FIGS. 4A to 4C. The manufacturing method is the same as that illustrated in FIG. 1 during the period from the preparation of the substrate 1 to the grinding of the filling material 9. Differences from the method illustrated in FIG. 1 are that, as illustrated in FIG. 4A, the discharge ports 10 are formed in the grinding-stop layer 7, dry etching is performed by using the grinding-stop layer 7 as a mask, and the discharge ports 10 are formed in the orifice plates 4 as illustrated in FIG. 4B, and that the grinding-stop layer 7 is removed as illustrated in FIG. 4C after the above processes. The process of forming the discharge ports 10 in the grinding-stop layer 7 may be the same as a process of removing a portion of an inorganic material, which has been formed in a film, that is not used as the grinding-stop layer 7. Alternatively, the process of forming the discharge ports 10 in the grinding-stop layer 7 may be performed after grinding of the filling material 9. In the case where the grinding-stop layer 7 is patterned after the grinding of the filling material 9, a photosensitive resin is applied onto the grinding-stop layer 7, masks are formed by patterning portions of the photosensitive resin that serve as the masks when the discharge ports 10 are formed, a portion of the grinding-stop layer 7 is removed by RIE using chlorine gas, and then, the masks are peeled off. The mold members 3 may be removed before the grinding-stop layer 7 is removed or may be removed after the grinding-stop layer 7 is removed. Alternatively, the mold members 3 may be removed at the same time as the grinding-stop layer 7 is removed.

Since the grinding-stop layer 7 is used as a mask in the above manufacturing method, the liquid discharge head can be manufactured with high manufacturing efficiency. In addition, the shape accuracy of each of the discharge ports 10 can be improved.

EXAMPLES

The present invention will be described more specifically below in terms of Examples.

Example 1

First, as illustrated in FIG. 2A, a substrate 1 that included energy generating elements 2 was prepared. The substrate 1 was made of silicon and was a (100) substrate that had a surface the crystal orientation of which was (100). The energy generating elements 2 were formed of TaSiN. SiN was formed on TaSiN as an insulating layer, and Ta was formed on SiN as a cavitation resistant layer. An Al wiring and an electrode pad (not illustrated) that were electrically connected to the energy generating elements 2 were formed on the substrate 1.

Next, as illustrated in FIG. 2B, mold members 3 that were configured to form the patterns of flow paths 11 and each of which corresponded to one of the energy generating elements 2 were formed. First, aluminum was formed in a film having a film thickness of 14 μm on the substrate 1 by sputtering, and masks were formed of a photosensitive resin on the aluminum film. Next, reactive ion etching using chlorine gas was performed on the aluminum film using the masks, so that the mold members 3 were formed. After that, the photosensitive resin that was used as the masks was peeled off.

Next, as illustrated in FIG. 2C, an inorganic material was formed by a chemical vapor deposition method in such a manner as to cover the substrate 1 and the mold members 3. SiN was used as the inorganic material, and a flow-path-forming member 5 that included orifice plates 4 was formed of SiN. The thickness of the flow-path-forming member 5 including the orifice plates 4 was 7.0 μm. SiN was formed in such a manner as to follow the shapes of the mold members 3, and a space 6 having a width of 10 μm and a depth of 14 μm in the cross section illustrated in FIG. 2C was formed between the mold members 3.

Next, as illustrated in FIG. 2D, a grinding-stop layer 7 was formed on the flow-path-forming member 5 in such a manner as to cover at least regions of the flow-path-forming member 5 in which discharge ports 10 were to be formed later. Aluminum was used as a material of the grinding-stop layer 7, and the aluminum was formed in a film having a film thickness of 1.0 μm by sputtering in such a manner as to be the grinding-stop layer 7.

Next, masks 13 were made of a photosensitive resin, and reactive ion etching using chlorine gas was performed using the masks 13, so that a portion of the grinding-stop layer 7, which had been formed, that was not used to stop grinding was removed. Then, the masks 13 were peeled off (FIG. 2E and FIG. 2F).

Next, as illustrated in FIG. 2G, a filling material 9 was applied to the entire surface of the substrate 1 including the space 6. A thermosetting novolac resin was used as the filling material 9, and the thickness of the filling material 9 from a surface of the substrate 1 was 30.0 μm in order to sufficiently fill the space 6 with the filling material 9. After the application of the filling material 9, the filling material 9 was cured by applying heat having a temperature of 350° C. to the filling material 9 for two hours.

Next, as illustrated in FIG. 2H, a filling member that was made of the filling material 9 was formed by grinding in such a manner that the top surface of the filling member, which was made of the filling material 9, was at the same height as the top surface of the grinding-stop layer 7. The grinding was performed using a chemical mechanical polishing method. An end point of the grinding was sensed by detecting a difference between the grinding speed at which the resin, which was the filling material 9, was ground and the grinding speed at which the grinding-stop layer 7 was ground on the basis of a decrease in grinding rate that occurs upon reaching the grinding-stop layer 7.

Next, as illustrated in FIG. 2I, the grinding-stop layer 7 was removed by chemical dry etching using a gas containing fluorine and oxygen as main components. Then, mask were formed of a photosensitive resin on the orifice plates 4 by photolithography, and the discharge ports 10 were formed by performing reactive ion etching on the orifice plates 4. After that, the masks were removed, and the mold members 3 were removed using phosphoric acid, so that the flow paths 11 were formed. Finally, a supply port was formed by performing dry etching on the substrate 1, and as a result, a liquid discharge head was manufactured.

In the liquid discharge head that was manufactured in Example 1, in the case where a direction in which liquid was to be discharged from the discharge ports 10 was an upward direction, the top surface of the filling member, which was made of the filling material 9, was 1.0 μm higher than a face surface of the flow-path-forming member 5. Therefore, the liquid discharge head in which the flow-path-forming member 5 did not easily get damaged even if there was a contact with a recording medium or the like was able to be manufactured.

Example 2

In Example 2, a liquid discharge head was manufactured in the same manner as Example 1 during the period from the preparation of the substrate 1 to the removal of the grinding-stop layer 7. In Example 2, after the grinding-stop layer 7 was removed, a seal member 14 was formed in a film on the top surface of the filling member that was made of the filling material 9 and on the face surface of the flow-path-forming member 5 as illustrated in FIG. 3. The manufacturing method of Example 2 was the same as that of Example 1 except for the above. The seal member 14 was formed by forming SiO in a film having a film thickness of 1.0 μm by a PECVD method. Then, the discharge ports 10 were formed also in the seal member 14 when the discharge ports 10 were formed in the orifice plates 4.

The liquid discharge head that was manufactured in Example 2 had a configuration in which the seal member 14 was formed on the top surface of the filling member, which was made of the filling material 9, and on the face surface of the flow-path-forming member 5. In the liquid discharge head that was manufactured in Example 2, the filling material 9 was not likely to make direct contact with liquid that was discharged or the like, and damage to the filling material 9 such as swelling and elution due to the liquid that was to be discharged was able to be suppressed.

Example 3

Although SiO was used as the seal member 14 in Example 2, SiN was used in Example 3. The manufacturing method of Example 3 was the same as that of Example 2 except for the above. In Example 3, the orifice plates 4 of the flow-path-forming member 5 and the seal member 14 were made of the same material, and the adhesion strength between the orifice plates 4 and the seal member 14 was able to be further improved.

Example 4

In Example 4, a liquid discharge head was manufactured in the same manner as Example 1 during the period from the preparation of the substrate 1 to the removal of the filling material 9. In Example 4, discharge port patterns were formed in the grinding-stop layer 7, and dry etching was performed using the grinding-stop layer 7 as a mask, so that discharge ports 10 were formed in the orifice plates 4. After that, the grinding-stop layer 7 was removed. A process of patterning the grinding-stop layer 7 in such a manner that the grinding-stop layer 7 served as the mask at the time of the formation of the discharge ports 10 was performed after the grinding of the filling material 9. The mold members 3 and the grinding-stop layer 7 were simultaneously removed. The manufacturing method of Example 4 was the same as that of Example 1 except for the above.

First, as illustrated in FIG. 4A, a photosensitive resin was applied to the grinding-stop layer 7. Then, masks were formed by patterning portions of the photosensitive resin that served as the masks when the discharge ports 10 were formed, and reactive ion etching using chlorine gas was performed using the masks, so that a part of the grinding-stop layer 7 was removed. After that, the masks were peeled off.

Next, as illustrated in FIG. 4B, dry etching was performed using the grinding-stop layer 7 as a mask, and the discharge ports 10 were formed. The dry etching was chemical dry etching using a gas containing fluorine and oxygen as main components.

Next, as illustrated in FIG. 4C, the mold members 3 and the grinding-stop layer 7 were removed, and the flow paths 11 were formed. As a result, the liquid discharge head was manufactured. In order to remove the mold members 3 and the grinding-stop layer 7, an etching liquid containing phosphoric acid as a main component was used.

In the liquid discharge head that was manufactured in the manner described above, the shape accuracy of each of the discharge ports 10 was able to be significantly improved.

According to the present invention, a liquid discharge head in which a flow-path-forming member does not easily get damaged even if there is a contact between the flow-path-forming member and a recording medium or the like can be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-251482 filed Nov. 15, 2012, which is hereby incorporated by reference herein in its entirety.

What is claimed is:

1. A liquid discharge head comprising:

a substrate;

a flow-path-forming member comprising a plurality of flow paths and discharge ports formed therein, wherein the discharge ports are in communication with the plurality of flow paths on the substrate; and a filling material filled in a space between the plurality of flow paths, the filling material having a top surface position higher than a top surface of the flow-path-forming member, and a bottom surface position lower than the top surface of the flow-path-forming member in a case where liquid is discharge from the discharge ports in an upward direction.

2. The liquid discharge head according to claim 1, wherein the flow-path-forming member is made of an inorganic material.

3. The liquid discharge head according to claim 1, wherein the filling material is made of a resin.

4. The liquid discharge head according to claim 1, wherein the top surface of the filling material is sealed with a seal member.

5. The liquid discharge head according to claim 4, wherein the seal member is formed in such a manner as to extend from the top surface of the filling material to the face surface of the flow-path-forming member and forms the discharge ports together with the flow-path-forming member.

6. The liquid discharge head according to claim 1, wherein the flow-path-forming member is made of at least one of silicon nitride, silicon dioxide, silicon carbide, and silicon carbonitride.

* * * * *